US011242193B2

(12) United States Patent
Calvo Guerrero

(10) Patent No.: US 11,242,193 B2
(45) Date of Patent: Feb. 8, 2022

(54) CIGAR BOX WITH DISPLAY FEATURE

(71) Applicant: Victor Antonio Calvo Guerrero, Opa Locka, FL (US)

(72) Inventor: Victor Antonio Calvo Guerrero, Opa Locka, FL (US)

( * ) Notice: Subject to any disclaimer, the term of this patent is extended or adjusted under 35 U.S.C. 154(b) by 0 days.

(21) Appl. No.: 16/906,099

(22) Filed: Jun. 19, 2020

(65) Prior Publication Data

US 2021/0394999 A1 Dec. 23, 2021

(51) Int. Cl.
*B65D 85/12* (2006.01)
*B65D 51/24* (2006.01)

(52) U.S. Cl.
CPC ..... *B65D 85/12* (2013.01); *B65D 51/245* (2013.01); *B65D 2203/02* (2013.01)

(58) Field of Classification Search
CPC ..... B65D 43/16; B65D 43/161; B65D 85/12; B65D 51/245; B65D 2203/02
USPC ..... 206/45.28, 242, 261, 276; 220/345.1, 220/345.2, 345.3, 255, 811, 826
See application file for complete search history.

(56) References Cited

U.S. PATENT DOCUMENTS 850,095 A * 4/1907 Palmer ..... B65D 85/12 206/265
1,539,757 A * 5/1925 Markland ..... B65D 85/12 217/57
1,859,523 A * 5/1932 Rodgers ..... B65D 5/6697 229/125.11
1,976,474 A * 10/1934 Arata ..... B65D 81/00 217/57
6,129,237 A * 10/2000 Miyahara ..... G06F 1/1656 220/812
2006/0000742 A1* 1/2006 Consulich ..... A45D 33/006 206/581
2006/0096873 A1* 5/2006 Fromm ..... G09B 17/00 206/232
2015/0075115 A1* 3/2015 Valls ..... A24F 15/12 53/411

* cited by examiner

*Primary Examiner* — Luan K Bui
(74) *Attorney, Agent, or Firm* — Mark Terry

(57) ABSTRACT

A housing unit for cigars with the main compartment having a cuboid shape. The cigar box has a rear wall having a height equal to a front wall, a bottom floor, a left-side wall having a height equal to a right-side wall and a two-part lid located on a top of the main compartment. The two-part lid has a rectangular portion hingably connected to a second rectangular portion with a first hinge that hingably connects the first rectangular portion with the second rectangular portion so that the first rectangular portion rotates about 180 degrees with respect to the second rectangular portion. The cigar box also has a second hinge that rotatably connects a rear of the second rectangular portion to a top of the rear wall such that the second rectangular portion rotates about 225 degrees with respect to the rear wall.

14 Claims, 13 Drawing Sheets

CIGAR BOX WITH DISPLAY FEATURE

CROSS-REFERENCE TO RELATED APPLICATIONS

Not applicable.

STATEMENT REGARDING FEDERALLY SPONSORED RESEARCH OR DEVELOPMENT

Not applicable.

INCORPORATION BY REFERENCE OF MATERIAL SUBMITTED ON A COMPACT DISC

Not applicable.

TECHNICAL FIELD

The claimed embodiments relate to the field of cigar boxes, and more specifically to the field of displaying cigar boxes that comply with governmental regulations.

BACKGROUND

A cigar box is a box container for cigar packaging. The Revenue Act of 1864 was signed into law in 1865 by President Lincoln and required that all cigars were to be packed in boxes. Cigar boxes made cigars cheaper and more available, and the associated boxes were often utilized for unique art and marketing opportunities. Today, many of these historic cigar boxes and their intricate artwork are considered collectible items.

Tobacco package warning messages are warning messages that appear on the packaging of tobacco products concerning their health effects. In May of 2016, the Food and Drug Administration, which regulates all tobacco products sold in the US, ruled that all cigar box lids must have 30 percent of their surface area covered with one of six different cigar warning labels, in a minimum of 12-point type, and be centered in the warning area in which the text is required to be printed and positioned such that the text of the required warning statement and the other information on that principal display panel have the same orientation. These warnings have been implemented in an effort to enhance the public's awareness of the harmful effects of smoking and all cigar manufacturers are required to display warnings prominently on their packages. These warnings, however, can be quite graphic and visually displeasing, since they may reference cancer, disease, and other negative effects of smoking. Many of said warnings include photographs of human diseases and abnormalities that can be quite displeasing.

Complying with the federal requirements has had a vast impact on the aesthetic and collectable nature of cigar boxes. The giant cancer warnings that are being placed on the top of the cigar boxes are taking away from the experience of selecting and appreciating the beautiful cigar boxes in a retail atmosphere. Specifically, cigar store owners are unable to display cigar boxes in an aesthetically pleasing way to consumers. This is making it extremely difficult for merchants to create a positive experience for their consumers and severely impacting the cigar store aesthetic.

Therefore, a need exists for improvements over the prior art, and more particularly for methods and systems that comply with federal requirements while still being aesthetically pleasing in the field of cigar boxes.

SUMMARY

An improved cigar box with a display feature is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, an improved cigar box is disclosed. The cigar box has a main compartment having a cuboid shape and includes: a) a rear wall having a height equal to a front wall; b) a bottom floor; c) a left-side wall having a height equal to a right-side wall, wherein the height of the left-side and right-side walls is greater than the height of the rear and front walls; d) a two-part lid located on a top of the main compartment, the two-part lid comprising a first rectangular portion hingably connected to a second rectangular portion; e) a first hinge that hingably connects the first rectangular portion with the second rectangular portion such that the first rectangular portion rotates about 180 degrees with respect to the second rectangular portion; and f) a second hinge that rotatably connects a rear of the second rectangular portion to a top of the rear wall such that the second rectangular portion rotates about 225 degrees with respect to the rear wall.

Additional aspects of the disclosed embodiment will be set forth in part in the description which follows, and in part will be obvious from the description, or may be learned by practice of the disclosed embodiments. The aspects of the disclosed embodiments will be realized and attained by means of the elements and combinations particularly pointed out in the appended claims. It is to be understood that both the foregoing general description and the following detailed description are exemplary and explanatory only and are not restrictive of the disclosed embodiments, as claimed.

BRIEF DESCRIPTION OF THE DRAWINGS

The accompanying drawings, which are incorporated in and constitute part of this specification, illustrate embodiments of the invention and together with the description, serve to explain the principles of the disclosed embodiments. The embodiments illustrated herein are presently preferred, it being understood, however, that the invention is not limited to the precise arrangements and instrumentalities shown, wherein.

DETAILED DESCRIPTION

Figure 1:
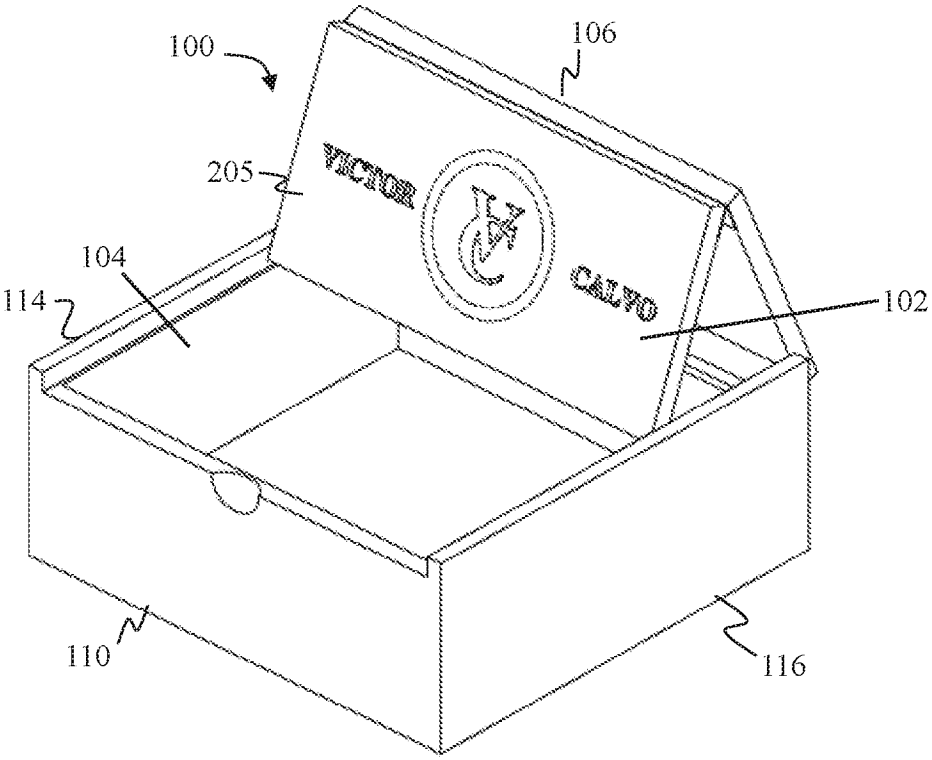
FIG. 1 is a drawing depicting the front perspective view of cigar box, in a semi-open position, according to an example embodiment.

The following detailed description refers to the accompanying drawings. Whenever possible, the same reference numbers are used in the drawings and the following description to refer to the same or similar elements. While disclosed embodiments may be described, modifications, adaptations, and other implementations are possible. For example, substitutions, additions, or modifications may be made to the elements illustrated in the drawings, and the methods described herein may be modified by substituting reordering or adding additional stages or components to the disclosed methods and devices. Accordingly, the following detailed description does not limit the disclosed embodiments. Instead, the proper scope of the disclosed embodiments is defined by the appended claims.

The claimed embodiments improve upon the prior art by providing a cigar box system optimized for compliance with government regulations while maintaining an aesthetic appeal to consumers. Historically, cigar boxes were unique pieces of art and inspired cigar aficionados across the globe. Government regulations have taken away from the aesthetic appeal and collectable nature of these boxes due to the large size requirements of warning labels. The claimed embodiments deal with this problem using a unique design including a hinging two-part lid, allowing for the distinct separation between art and compliance. Specifically, the claimed embodiments provide a method for displaying the cigar box in an aesthetically pleasing way by arranging the box so that the warning label faces towards the rear, and the manufacturer logo and interior of the cigar box faces forwards and upwards, which is optimal for display case purposes. Therefore, the claimed embodiments allow for the cigar box to be displayed in a manner that highlights the cigars and the manufacturer logo while hiding or occluding the warning label when the device is displayed in a display case or shelf.

Referring now to the Figures, FIGS. 1-13 illustrate a cigar box 100 according to an example embodiment and will be discussed together for ease of reference. The cigar box 100 having a cuboid shaped main compartment 104, a rear wall 112 having a height equal to a front wall 110, a bottom floor 118, a left-side wall 114 having a height equal to a right-side wall 116, wherein the height of the left-side 114 and right-side 116 walls is greater than the height of the rear 112 and front 110 walls. The cigar box 100 includes a two-part lid located on a top of the main compartment 104, the two-part lid comprising a first rectangular portion 102 hingably connected to a second rectangular portion 108. A first hinge 106 that hingably connects the first rectangular portion 102 with the second rectangular portion 108 such that the first rectangular portion 102 rotates about 180 degrees with respect to the second rectangular portion 108 and a second hinge 120 that rotatably connects a rear of the second rectangular portion 108 to a top of the rear wall 112 such that the second rectangular portion 108 rotates about 225 degrees with respect to the rear wall 112. The first hinge 106 further includes a stopper that prevents the first rectangular portion from rotating more than about 180 degrees with respect to the second rectangular portion.

FIG. 1 is a front perspective view of the cigar box 100 wherein the first rectangular portion 102 that is hingably connected to the second rectangular portion 108 with the first hinge 106 rotates about 180 degrees with respect to the second rectangular portion 108, and wherein when the second rectangular portion 108 rotates about 225 degrees with respect to the rear wall 112, the inner volume of the main compartment 104, left side wall 114, right side wall 116 and front wall 110 is visible from an exterior position, according to an example embodiment. FIG. 1 shows the cigar box 100 in a semi-open position wherein the first rectangular portion 102 has been rotated about 45 degrees with respect to the second rectangular portion 108 (assuming both the first and second rectangular portions started at a zero-degree angle, there is an interior angle between 102 and 108 of about 45 degrees). In the semi-open position, the second rectangular portion 108 has been rotated about 135 degrees with respect to the rear wall 112 (assuming both the rear wall and second rectangular portions started at a zero-degree angle, there is an interior angle between 112 and 108 of about 135 degrees). Note that in the semi-open position, the outward facing surface 204 of the second rectangular portion 108 is hidden from view from a viewer located in front of the cigar box, but the outward facing surface 205 of the first rectangular portion 102 is viewable to the viewer. The semi-open position also allows the interior components of the main compartment to be viewable to said viewer while hiding the governmental warning 206 from view. As such, in the semi-open position, the cigar box can be placed in a display or shelf, which allows the interior of the box and the manufacturer logo 207 to be viewable, while hiding the governmental warning 206. In addition to the manufacturer logo 207, the outward facing surface 205 of the first rectangular portion 102 may also include product data, graphics, advertising, manufacturer information, writing, product source information, product ingredient information, etc. In addition to the governmental warning 206, the outward facing surface 204 of the second rectangular portion 108 may also include warning data, graphics, photos, governmental data, medical data, governmental source, etc.

Figure 2:
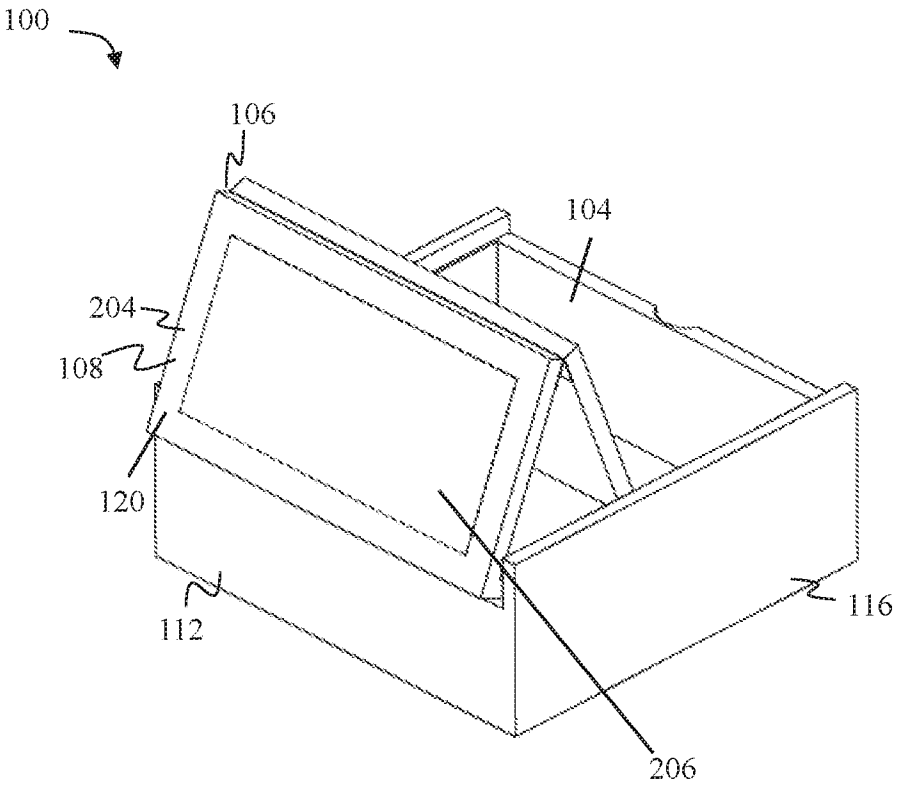
FIG. 2 is a drawing depicting the rear perspective view of the cigar box, in a semi-open position, according to an example embodiment.

FIG. 2 is a rear perspective view of the cigar box 100 in a semi-open position wherein the inner volume of the main compartment 104, and its contents, are open for viewing. Note in FIG. 2 that the governmental warning 206 faces the rear of the cigar box.

Figure 3:
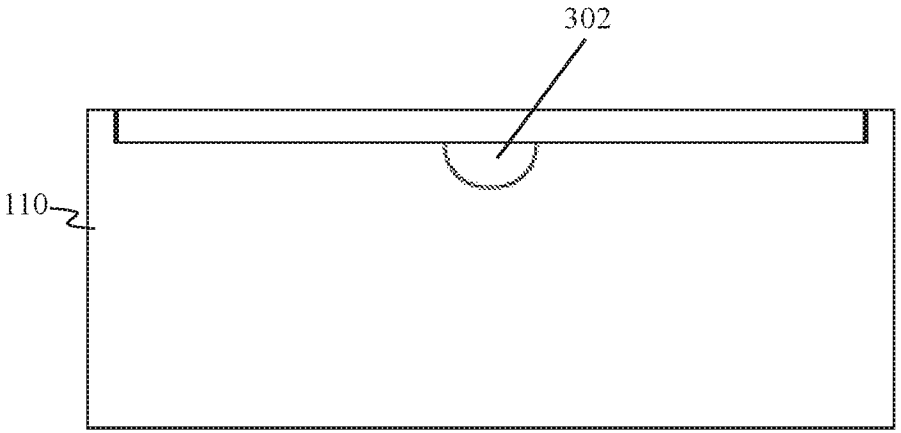
FIG. 3 is a drawing depicting a front view of the cigar box, in a closed position, according to an example embodiment.

FIG. 3 is a drawing depicting a front view of the cigar box with a depression 302 inset in a top of the outward-facing surface of the front wall 110, wherein the depression is configured to allow insertion of a finger, according to an example embodiment. FIG. 3 shows the cigar box in a closed position wherein the first rectangular portion 102 is colinear with the second rectangular portion 108 (i.e., the first and second rectangular portions are at a 180 degree angle to each other) and wherein the second rectangular portion 108 is in a 90 degree or right-angle orientation with respect to the rear wall 112.

Figure 4:
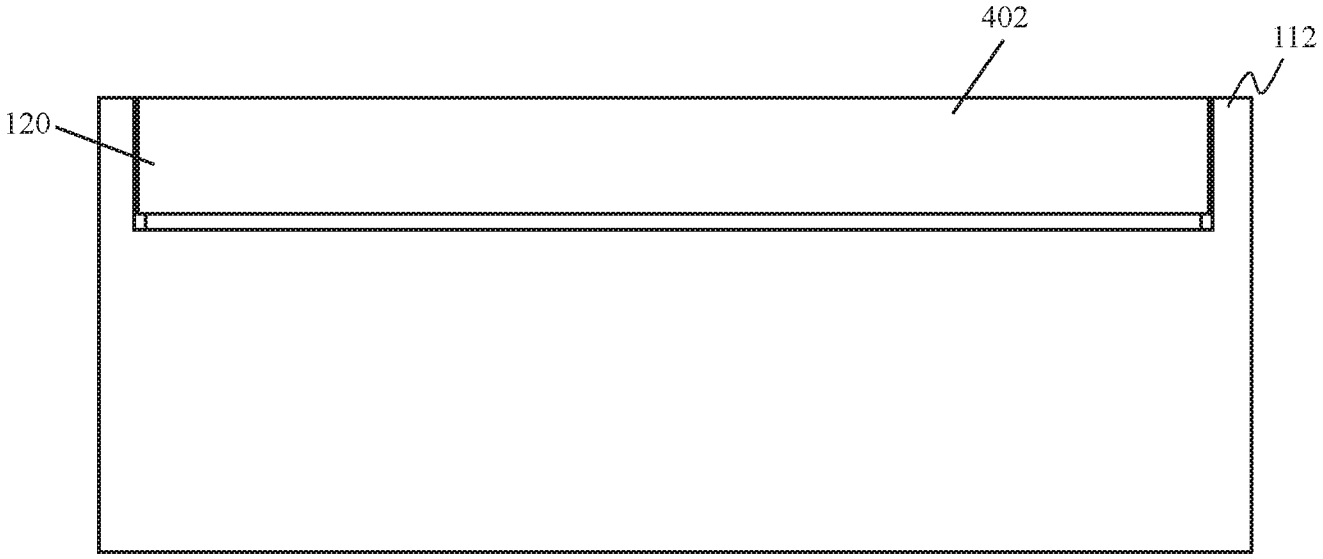
FIG. 4 is a drawing depicting a rear view of the cigar box, in a closed position, according to an example embodiment.

FIG. 4 is a drawing depicting a rear view of the cigar box 100 and a second hinge 120 wherein the second rectangular portion 108 is rotatably connected to the top of the rear wall 112, according to an example embodiment. The second hinge further includes a stopper 402 that prevents the second rectangular portion from rotating more than about 225 degrees with respect to the rear wall.

Figure 5:
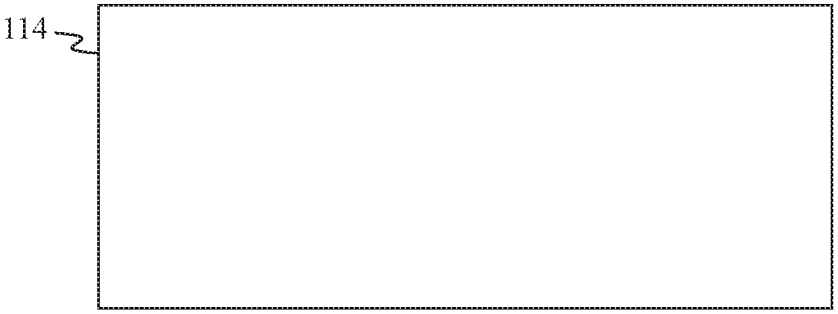
FIG. 5 is a drawing depicting a left side view of the cigar box, in a closed position, according to an example embodiment.
Figure 6:
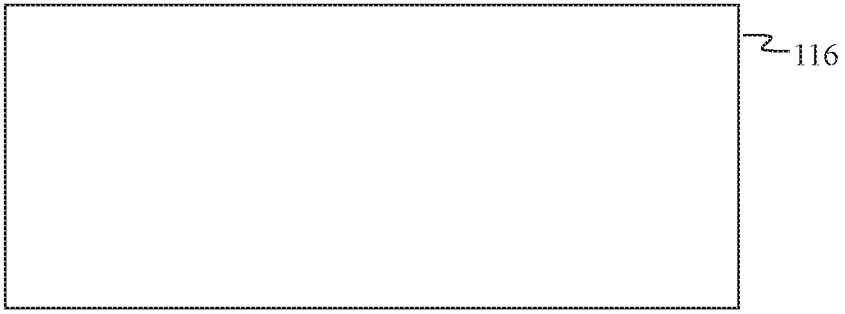
FIG. 6 is a drawing depicting a right-side view of the cigar box, in a closed position, according to an example embodiment.

FIG. 5 is a drawing depicting a left side view of the cigar box 100 in a closed position, according to an example embodiment. FIG. 6 is drawing depicting a right-side view of the cigar box 100 in a closed position, according to an example embodiment.

Figure 7:
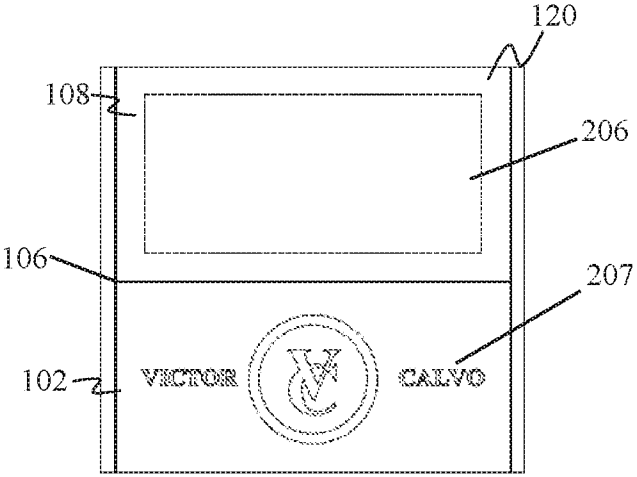
FIG. 7 is a drawing depicting a top view of the cigar box in a closed position, according to an example embodiment.

FIG. 7 is a drawing depicting a top view of the cigar box 100 in a closed position, wherein the first hinge 106 hingably connects the first rectangular portion 102 with the second rectangular portion 108 and a second hinge 120 connects to the second rectangular portion 108 according to an example embodiment. Note that the first rectangular portion 102 is colinear with the second rectangular portion 108 (i.e., the first and second rectangular portions are at a 180-degree angle to each other). FIG. 7 shows the placement of the manufacturer logo 207 and the governmental warning 206.

Figure 8:
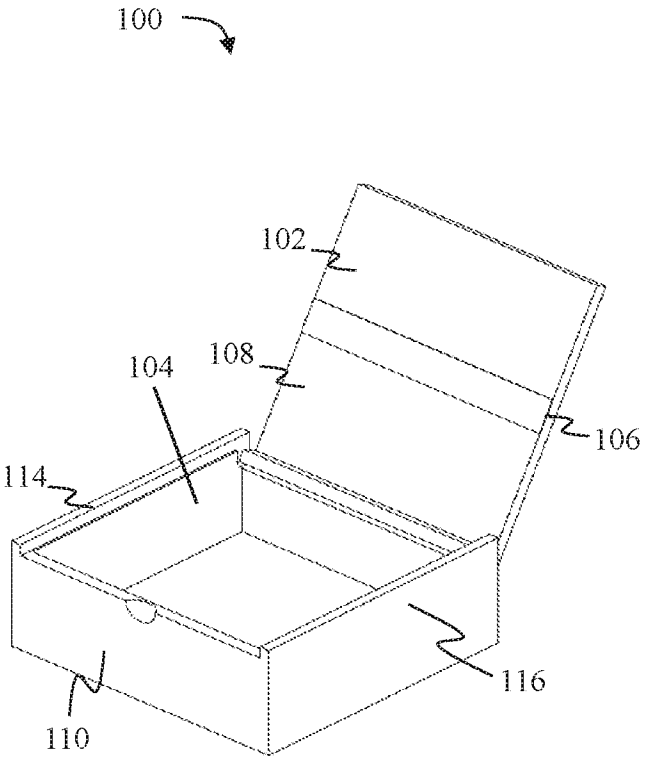
FIG. 8 is a drawing depicting a front perspective view of the cigar box, in a fully open position, according to an example embodiment.

FIG. 8 is a drawing depicting a front perspective view of the cigar box 100 in a fully open position, wherein the first rectangular portion 102 is colinear with the second rectangular portion 108, and wherein the second rectangular portion 108 has been rotated about 225 degrees with respect to the rear wall. In this position, the inner volume of the main compartment 104, and its components, is visible from an exterior position, according to an example embodiment.

Figure 9:
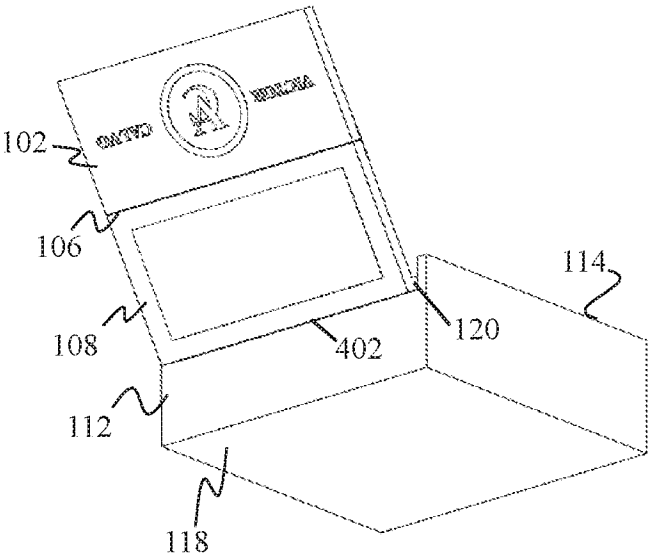
FIG. 9 is a drawing depicting a rear perspective view of the cigar box, in a fully open position, according to an example embodiment.

FIG. 9 is a drawing depicting a rear perspective view of the cigar box 100 in a fully open position. Note the second rectangular portion 108 has been rotated about 225 degrees with respect to the rear wall and the first rectangular portion 102 is colinear with the second rectangular portion 108 (i.e., there is a 180-degree angle between them).

Figure 10:
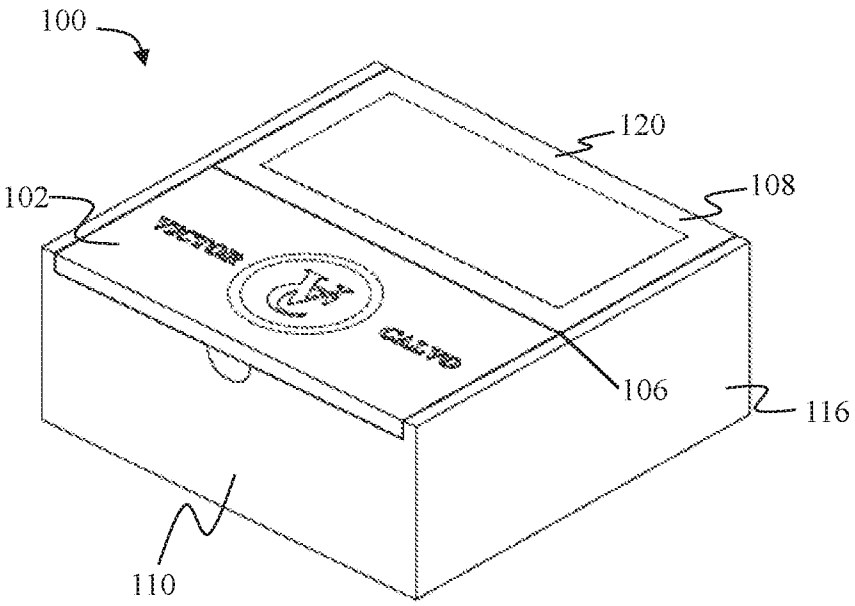
FIG. 10 is a drawing depicting a top perspective view of a cigar box, in a closed position, according to an example embodiment.

FIG. 10 is a drawing depicting a top perspective view of a cigar box 100, in a closed position. The cigar box 100 has a closed a two-part lid comprising a first rectangular portion 102 hingably connected to a second rectangular portion 108. The first hinge 106 hingably connects the first rectangular portion 102 with the second rectangular portion 108. The right-side wall 116 and front wall 110 are visible from an exterior position, according to an example embodiment. Note the first rectangular portion 102 is colinear with the second rectangular portion 108 (i.e., there is a 180-degree angle between them).

Figure 11:
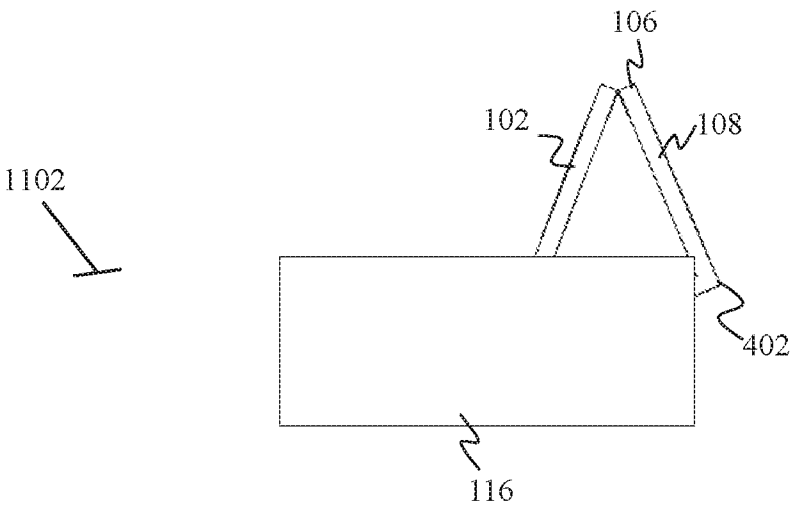
FIG. 11 is a drawing depicting a right-side view of the cigar box, in a semi-open position, according to an example embodiment.

FIG. 11 is a drawing depicting a right-side view of the cigar box 100 in a semi-open position. In this position, the first rectangular portion 102 has been rotated around hinge 106 about 45 degrees with respect to the second rectangular portion 108 (assuming both the first and second rectangular portions started at a zero-degree angle). In the semi-open position, the second rectangular portion 108 has been rotated about 135 degrees with respect to the rear wall 112 (assuming both the rear wall and second rectangular portions started at a zero-degree angle). A stopper 402 prevents the second rectangular portion from rotating more than about 225 degrees with respect to the rear wall. The stopper may be an angled juncture of the second rectangular portion 108 that includes an L-shape at the proximal portion that is hingably coupled with hinge 120, wherein the angled juncture produces an acute or 90-degree angle that juts out and then collides with the rear wall 112 (as shown in FIG. 9), when the second rectangular portion is rotated to about 225 degrees with respect to the rear wall.

Note that in the semi-open position, the outward facing surface 204 of the second rectangular portion 108 is hidden from view from a viewer located in front 1102 of the cigar box, but the outward facing surface 205 of the first rectangular portion 102 is viewable to the viewer. The semi-open position also allows the interior components of the main compartment to be viewable to said viewer while hiding the governmental warning 206 from view. As such, in the semi-open position, the cigar box can be placed in a display or shelf, which allows the interior of the box and the manufacturer logo 207 to be viewable, while hiding the governmental warning 206.

Figure 12:
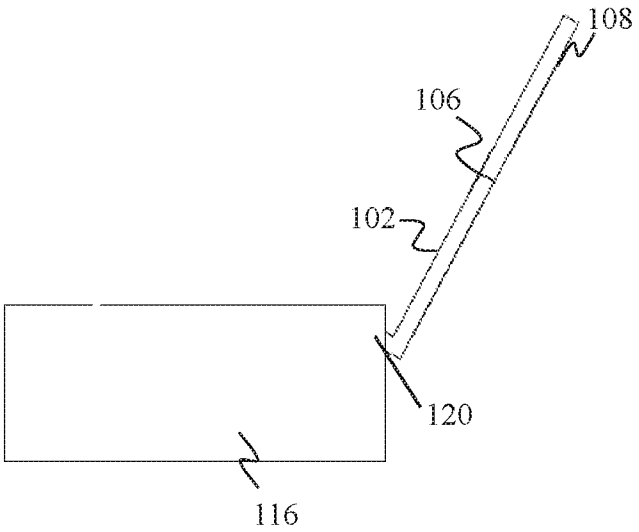
FIG. 12 is a drawing depicting a right-side view of the cigar box, in a fully open position, according to an example embodiment.
Figure 13:
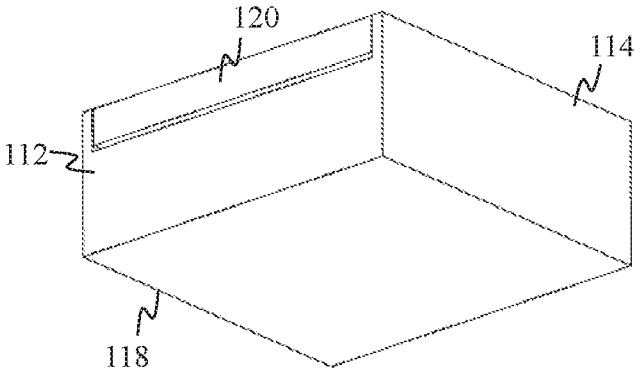
FIG. 13 is a drawing depicting a rear perspective view of the cigar box, in a closed position, according to an example embodiment.

FIG. 12 is a drawing depicting a right-side view of the cigar box 100 in a fully open position. In this position, the first rectangular portion 102 is colinear with the second rectangular portion 108, and the second rectangular portion 108 has been rotated about 225 degrees with respect to the rear wall. In this position, the inner volume of the main compartment 104, and its components, is visible from an exterior position, according to an example embodiment. FIG. 13 is a drawing depicting a rear perspective view of the cigar box 100 in a closed position.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

I claim:

1. A cigar box comprising a main compartment having a cuboid shape and including:

a. a rear wall having a height equal to a front wall;

b. a bottom floor;

c. a left-side wall having a height equal to a right-side wall, wherein the height of the left-side and right-side walls is greater than the height of the rear and front walls;

d. a two-part lid located on a top of the main compartment, the two-part lid comprising a first rectangular portion hingably connected to a second rectangular portion;

e. a first hinge that hingably connects the first rectangular portion with the second rectangular portion such that the first rectangular portion rotates 180 degrees with respect to the second rectangular portion; wherein the first hinge includes a first stopper that prevents the first rectangular portion from rotating more than 180 degrees with respect to the second rectangular portion; and f. a second hinge that rotatably connects a rear of the second rectangular portion to a top of the rear wall such that the second rectangular portion rotates 225 degrees with respect to the rear wall, wherein the second hinge further includes a second stopper that prevents the second rectangular portion from rotating more than 225 degrees with respect to the rear wall.

2. The cigar box of claim 1, further comprising a depression inset in a top of an outward-facing surface of the front wall, wherein the depression is configured to allow insertion of a finger.

3. The cigar box of claim 1, wherein when the first rectangular portion rotates 45 degrees with respect to the second rectangular portion, and wherein when the second rectangular portion rotates 135 degrees with respect to the rear wall, the inner volume of the main compartment is visible from an exterior position.

4. The cigar box of claim 1, wherein when the first rectangular portion rotates 45 degrees with respect to the second rectangular portion, and wherein when the second rectangular portion rotates 135 degrees with respect to the rear wall, the second rectangular portion of the two-part lid is hidden from a viewer located in a front of the cigar box.

5. The cigar box of claim 1, wherein the interior volume of the box is configured for storing cigars.

6. The cigar box of claim 1, wherein the interior volume of the box is configured for displaying cigars.

7. The cigar box of claim 1, wherein the first rectangular portion of the two-part lid is configured for displaying a logo.

8. The cigar box of claim 1, wherein the second rectangular portion of the two-part lid is configured for displaying a governmentally required graphic.

9. A cigar box comprising a main compartment having a cuboid shape and including:

a. a rear wall having a height equal to a front wall;

b. a bottom floor;

c. a left-side wall having a height equal to a right-side wall, wherein the height of the left-side and right-side walls is greater than the height of the rear and front walls;

d. a two-part lid located on a top of the main compartment, the two-part lid comprising a first rectangular portion hingably connected to a second rectangular portion, wherein an outward facing surface of the first rectangular portion includes a graphic logo and wherein an outward facing surface of the second rectangular portion includes a governmental warning;

e. a first hinge that hingably connects the first rectangular portion with the second rectangular portion such that the first rectangular portion rotates 180 degrees with respect to the second rectangular portion, wherein the first hinge further includes a stopper that prevents the first rectangular portion from rotating more than 180 degrees with respect to the second rectangular portion; and f. a second hinge that rotatably connects a rear of the second rectangular portion to a top of the rear wall such that the second rectangular portion rotates 225 degrees with respect to the rear wall, wherein the second hinge further includes a stopper that prevents the second rectangular portion from rotating more than 225 degrees with respect to the rear wall.

10. The cigar box of claim 9, further comprising a depression inset in a top of an outward-facing surface of the front wall, wherein the depression is configured to allow insertion of a finger.

11. The cigar box of claim 9, wherein when the first rectangular portion rotates 45 degrees with respect to the second rectangular portion, and wherein when the second rectangular portion rotates 135 degrees with respect to the rear wall, the inner volume of the main compartment is visible from an exterior position.

12. The cigar box of claim 9, wherein when the first rectangular portion rotates 45 degrees with respect to the second rectangular portion, and wherein when the second rectangular portion rotates 135 degrees with respect to the rear wall, the second rectangular portion of the two-part lid is hidden from a viewer located in a front of the cigar box.

13. The cigar box of claim 9, wherein the interior volume of the box is configured for storing cigars.

14. The cigar box of claim 9, wherein the interior volume of the box is configured for displaying cigars.

* * * * *